US009748054B2

(12) United States Patent
Kinoshita et al.

(10) Patent No.: US 9,748,054 B2
(45) Date of Patent: Aug. 29, 2017

(54) CONTACT DEVICE

(71) Applicant: PANASONIC INTELLECTUAL PROPERTY MANAGEMENT CO., LTD., Osaka (JP)

(72) Inventors: Kazuhisa Kinoshita, Aichi (JP); Hideki Watanabe, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 1 day.

(21) Appl. No.: 14/710,516

(22) Filed: May 12, 2015

(65) Prior Publication Data

US 2015/0325390 A1 Nov. 12, 2015

(30) Foreign Application Priority Data

May 12, 2014 (JP) ..... 2014-098937

(51) Int. Cl.

| | |
|---|---|
| ***H01H 9/44*** | (2006.01) |
| ***H01H 50/64*** | (2006.01) |
| ***H01H 50/58*** | (2006.01) |
| ***H01H 50/04*** | (2006.01) |

(52) U.S. Cl.

CPC ..... *H01H 9/443* (2013.01); *H01H 50/041* (2013.01); *H01H 50/58* (2013.01); *H01H 50/645* (2013.01); *H01H 9/446* (2013.01); *H01H 50/642* (2013.01)

(58) Field of Classification Search

CPC ..... H01H 9/443; H01H 9/446; H01H 50/642

USPC ..... 335/78–86, 201

See application file for complete search history.

(56) References Cited

U.S. PATENT DOCUMENTS

| | | | | |
|---|---|---|---|---|
| 8,193,881 | B2 * | 6/2012 | Yuba | H01H 9/443 335/128 |
| 2014/0028418 | A1 * | 1/2014 | Yamashita | H01H 9/40 335/201 |

FOREIGN PATENT DOCUMENTS

| | | | |
|---|---|---|---|
| EP | 2 688 084 | A1 | 1/2014 |
| JP | 60-107551 | U | 7/1985 |
| JP | 2009-146759 | A | 7/2009 |
| JP | 2013-080692 | A | 5/2013 |

* cited by examiner

*Primary Examiner* — Ramon M Barrera

(74) *Attorney, Agent, or Firm* — McDermott Will & Emery LLP

(57) ABSTRACT

The fixed contact member includes a fixed contact. The movable contact member includes a movable contact and is movable between a position where the movable contact is in contact with the fixed contact and a position where the movable contact is away from the fixed contact. The permanent magnet forms a magnetic field around the fixed contact. The case is for accommodating at least the fixed contact member and the movable contact member. Further, the case includes an accommodation part which is partitioned from an internal space of the case and is for accommodating the permanent magnet through an opening thereof directed to an outside of the case.

10 Claims, 8 Drawing Sheets

CONTACT DEVICE

CROSS-REFERENCE TO RELATED APPLICATIONS

The application is based upon and claims the benefit of priority of Japanese Patent Application No. 2014-98937, filed on May 12, 2014, the entire contents of which are incorporated herein by reference.

TECHNICAL FIELD

The present invention generally relates to contact devices and in particular relates to a contact device including a fixed contact and a movable contact.

BACKGROUND ART

In the past, there has been proposed an electromagnetic relay which opens and closes contacts depending on whether an electromagnetic block is excited (e.g., JP 2013-80692 A (hereinafter referred to as "document 1"). The electromagnetic relay disclosed in document 1 includes: an electromagnetic block; an armature to swing depending on whether the electromagnetic block is excited; a movable contact member which includes a movable contact and is to swing in accordance with swing of the armature; and a fixed contact member including a fixed contact to be in contact with and separate from the movable contact of the movable contact member.

In this electromagnetic relay, the armature is turned clockwise by spring force caused by a hinge spring while the electromagnetic block in not excited. At this time, the movable contact is separate from the fixed contact. When a coil is energized to excite the electromagnetic block, the armature is attracted to an iron core of the electromagnetic block and thereby turned counterclockwise. As a result, the movable contact is in contact with the fixed contact.

In the electromagnetic relay disclosed in the aforementioned document 1, a permanent magnet is placed close to the movable contact and the fixed contact in order to elongate and extinguish an arc which occurs when the movable contact moves apart from the fixed contact. Therefore, in a process of accommodating the permanent magnet in a case, foreign substances occurring in a production process may adhere to the permanent magnet, and thus the permanent magnet with such foreign substances may be accommodated in the case. Consequently, the foreign substances inside the case are likely to be present between the movable contact and the fixed contact, and this may cause incomplete contact. Or the foreign substances are likely to be present between moving parts and this causes malfunction.

SUMMARY OF INVENTION

In view of the above insufficiency, the present invention has aimed to propose a contact device capable of suppressing a decrease in breaking performance.

The contact device of one aspect of the present includes: a fixed contact member including a fixed contact; a movable contact member which includes a movable contact and is movable between a position where the movable contact is in contact with the fixed contact and a position where the movable contact is away from the fixed contact; a permanent magnet forming a magnetic field around the fixed contact; and a case for accommodating at least the fixed contact member and the movable contact member. The case includes an accommodation part which is partitioned from an internal space of the case and is for accommodating the permanent magnet through an opening thereof directed to an outside of the case.

DESCRIPTION OF EMBODIMENTS

Hereinafter, the contact device (electromagnetic relay) of one embodiment in accordance with the present invention is described in detail with reference to attached drawings. Note that, the contact device of the present invention is not limited to the present embodiment, and may have various configurations within the technical scope of the present invention. Unless otherwise noted, the following descriptions are made based on forward and rearward, left and right, and upward and downward directions defined in FIG. 2.

Figure 1:
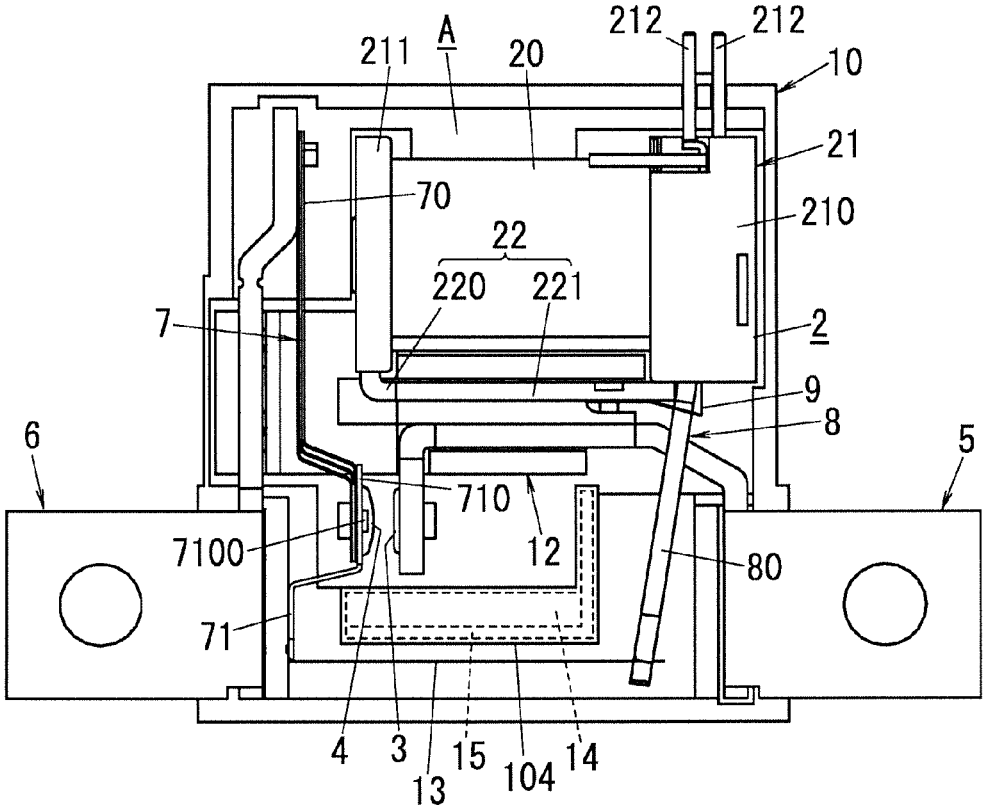
FIG. 1 is a plan illustrating the contact device of one embodiment in accordance with the present invention without the cover.
Figure 2:
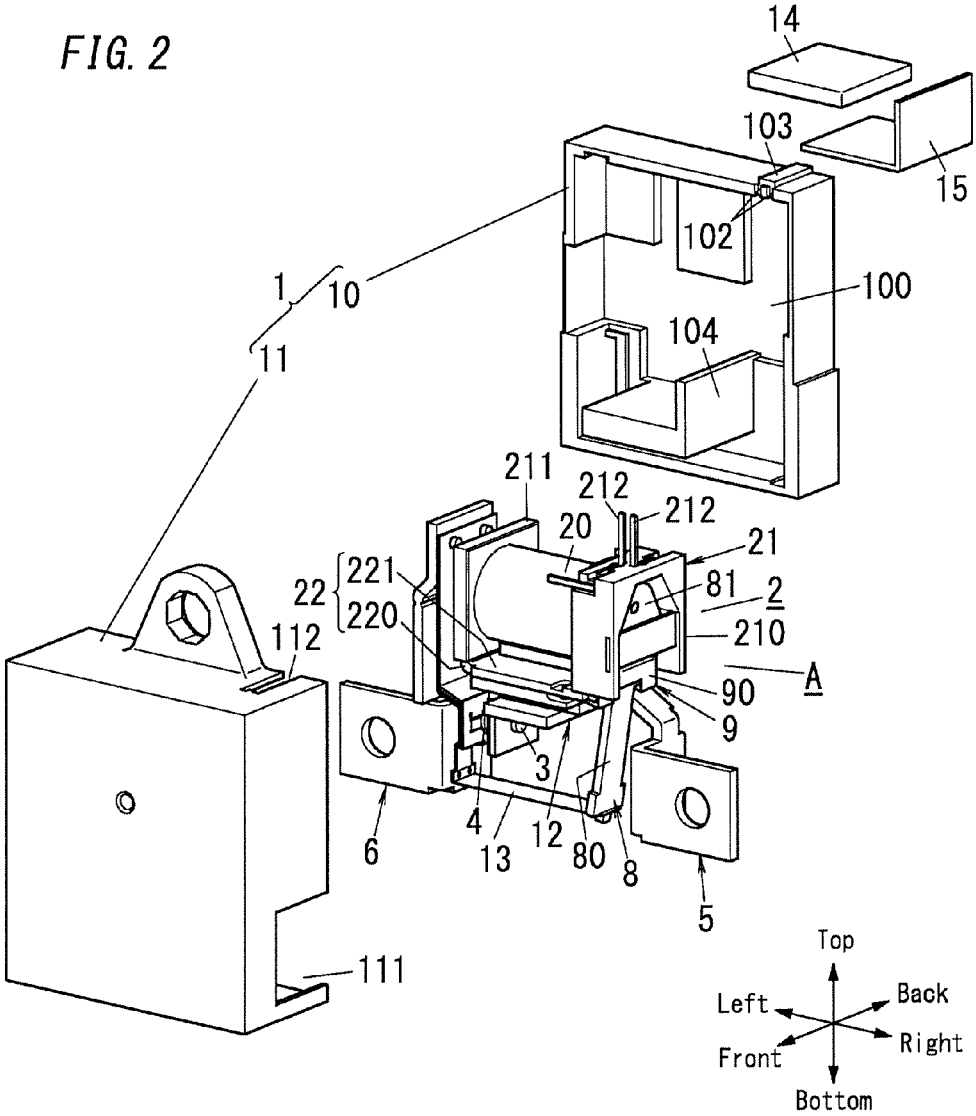
FIG. 2 is an exploded perspective view illustrating the contact device of the embodiment in accordance with the present invention.
Figure 3:
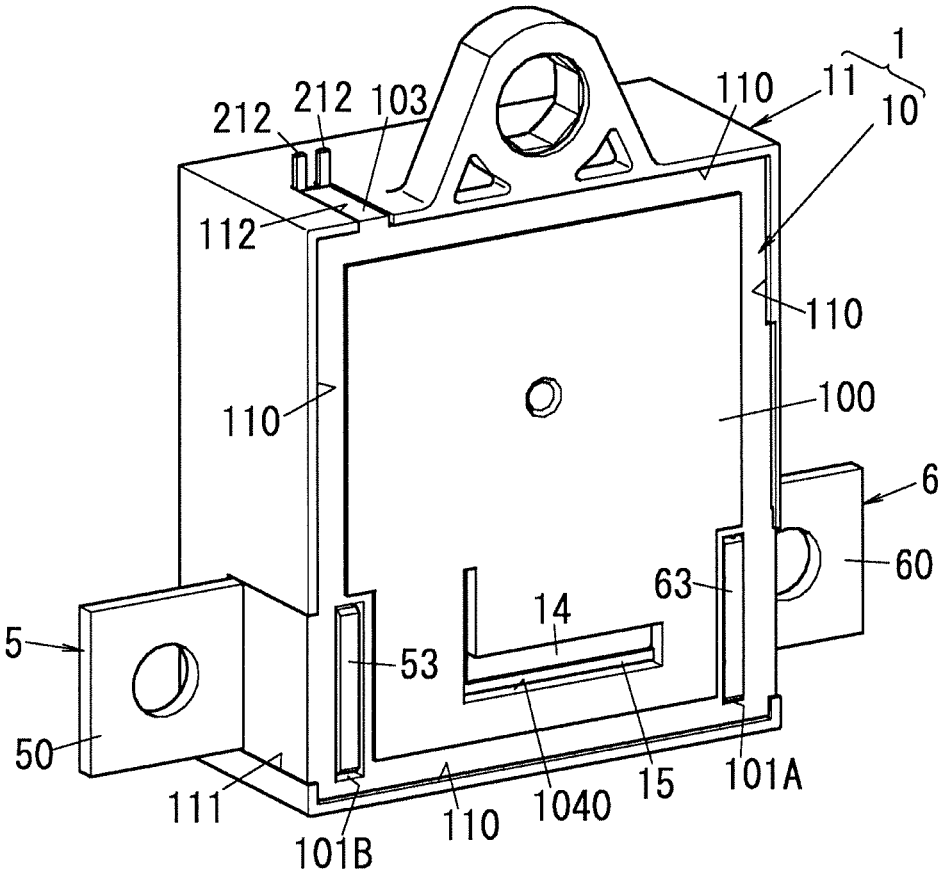
FIG. 3 is a perspective view illustrating the rear side of the contact device of the embodiment in accordance with the present invention.

As shown in FIG. 1 to FIG. 3, the contact device of the present embodiment includes a case (outer casing) 1 constituted by a body 10 and a cover 11. The body 10 is a synthetic resin molded product in a rectangular box shape with an open face. The cover 11 is a synthetic resin molded product in a rectangular box shape with an open face. The case 1 is assembled by covering the body 10 with the cover 11.

Note that, there is a tiny flange 110 protruding inward from the almost entire periphery of an opening of the cover 11. The bottom of the body 10 is caught by the flange 110, and therefore the body 10 and the cover 11 are coupled so that separation of the body 10 and the cover 11 is prevented (see FIG. 3). Alternatively, a coupling method allowing prevention of separation is not limited to the above method. For example, instead of providing the flange 110, the body 10 and the cover 11 may be coupled with adhesive (sealant).

Further, the contact device of the present embodiment includes a relay body A which is constituted by a driving block, a contact block, and a positioning member 12 and is situated in the case 1.

The driving block includes a driver 2, an armature 8, a hinge spring 9, and a card 13. The driver 2 is an electromagnet including a bobbin 21, a coil 20 formed by winding a wire around the bobbin 21, an iron core 23 (see FIG. 8) situated in a center of the bobbin 21, and a heel piece 22.

The bobbin 21 includes a barrel inside the coil 20, a first flange 210 provided to one axial end of the barrel, and a second flange 211 provided to the other axial end of the barrel. Note that, in this bobbin 21, it is preferable that the barrel and the pair of flanges 210 and 211 be formed integrally by use of insulating material such as synthetic resin.

The first flange 210 is in a flat rectangular box shape with one open bottom (right side) and one open side (lower face) (see FIG. 2). There is a pair of coil terminals 212 protruding outward (upward) in a diameter direction of the barrel from a side (upper face) of the first flange 210. The pair of coil terminals 212 are individually connected to both ends of the coil 20. When a voltage is applied between the pair of coil terminals 212 and 212, current flows through the coil 20 and therefore the driver (electromagnet) 2 is excited.

The heel piece 22 is in an L-shape, and includes a holding piece 220 held by the second flange 211, and a main piece 221 extending from an end of the holding piece 220 to the first flange 210 which are formed integrally by use of magnetic material (see FIG. 1).

The armature 8 includes a driving piece 80 in a band plate shape, and a supporting piece 81 which is in a flat plate shape and is wider than the driving piece 80. The driving piece 80 and the supporting piece 81 are formed integrally by use of magnetic material. The supporting piece 81 is accommodated in the first flange 210, and is fixed to a first fixing piece 90 of the hinge spring 9 (see FIG. 2 and FIG. 6). Further, the supporting piece 81 faces an end of the iron core 23 exposed on an inner bottom of the first flange 210.

The driving piece 80 protrudes to an outside of the first flange 210 through the open side (lower face) of the first flange 210. Further, the driving piece 80 abuts on a front end of the main piece 221 of the heel piece 22 (see FIG. 4). Note that, there is a projection 82 in a cuboidal shape provided to a front end face (lower end face) of the driving piece 80.

The hinge spring 9 includes the first fixing piece 90, a second fixing piece 91, and a pair of spring pieces 92. The first fixing piece 90, the second fixing piece 91, and the pair of spring pieces 92 are formed integrally by use of a plate spring (see FIG. 6). The first fixing piece 90 is in a rectangular flat plate shape and is fixed (swaged) to the supporting piece 81 of the armature 8. The second fixing piece 91 is in a rectangular flat plate shape, and is fixed (swaged) to the main piece 221 of the heel piece 22. The pair of spring pieces 92 each are in an L-shape, and include opposite ends in a length direction coupled to the first fixing piece 90 and the second fixing piece 91, respectively.

When the armature 8 is driven by the driver 2, the armature 8 turns around a fulcrum defined by a part of the armature 8 in contact with the main piece 221 of the heel piece 22, in a direction (counterclockwise in FIG. 1) in which the supporting piece 81 moves close to the iron core 23. When the armature 8 is not driven by the driver 2, the armature 8 turns in a direction (clockwise in FIG. 1) in which the supporting piece 81 moves away from the iron core 23.

The contact block includes a fixed contact 3, a movable contact 4, a first terminal 5, a second terminal 6, and a contact spring 7.

Figure 4:
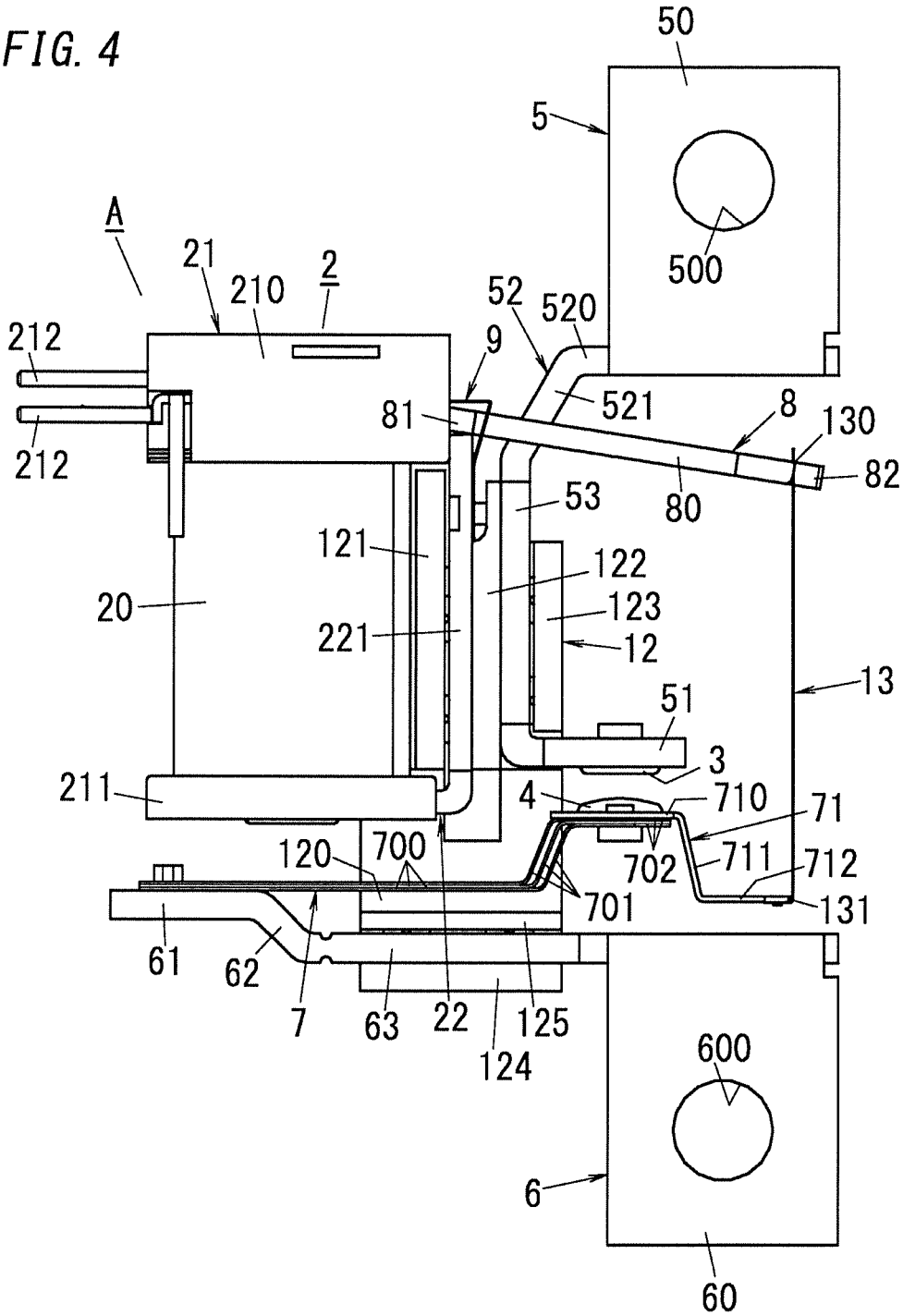
FIG. 4 is a front view illustrating the relay body of the contact device of the embodiment in accordance with the present invention.
Figure 6:
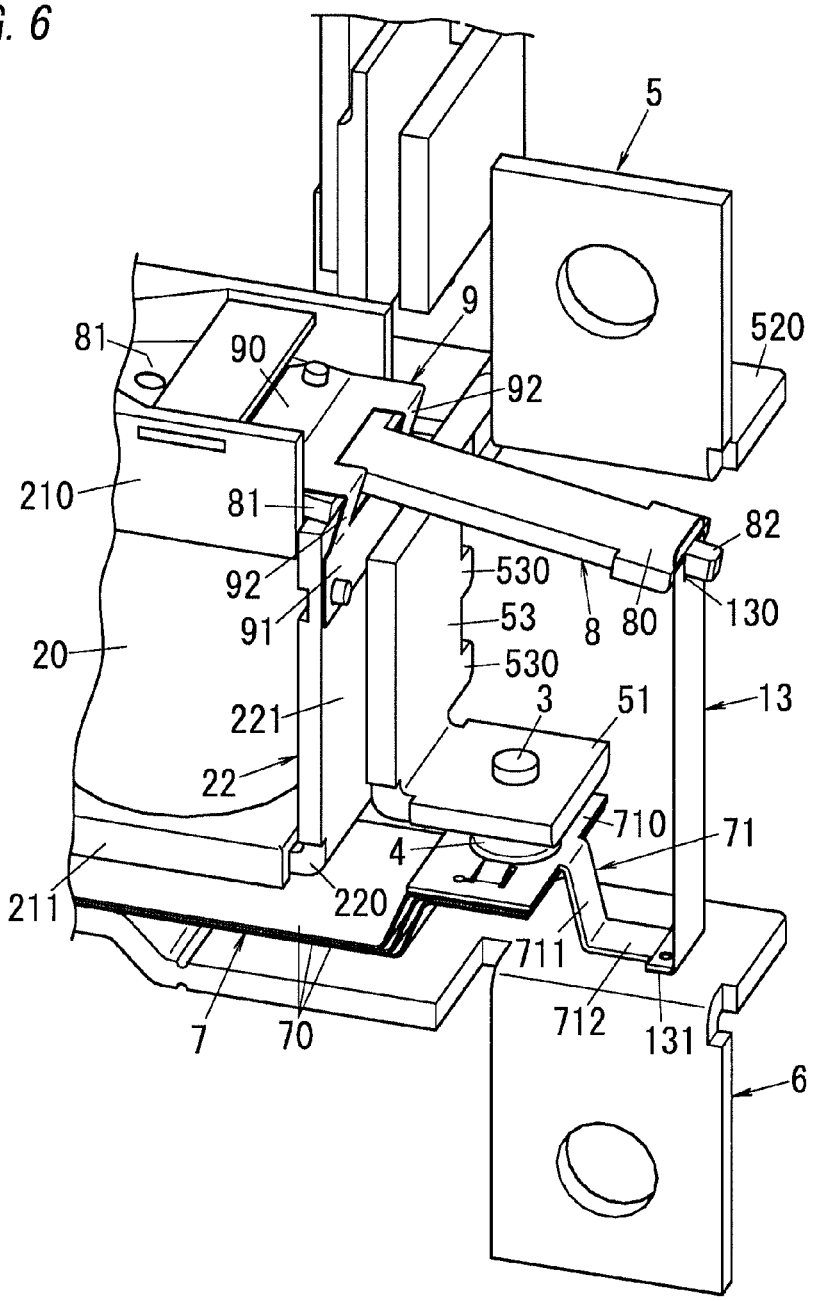
FIG. 6 is a partial perspective view illustrating the relay body of the contact device of the embodiment in accordance with the present invention.
Figure 7D:
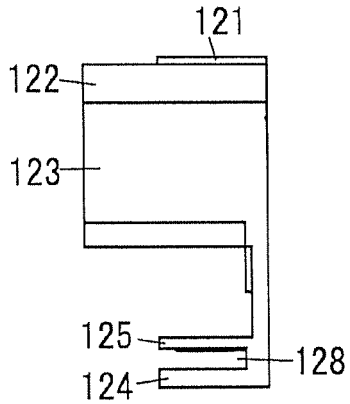
FIG. 7A, FIG. 7B, FIG. 7C, FIG. 7D, FIG. 7E, and FIG. 7F are front, left side, right side, top, bottom, and rear views of the positioning member of the contact device of the embodiment in accordance with the present invention, respectively.
Figure 7B:
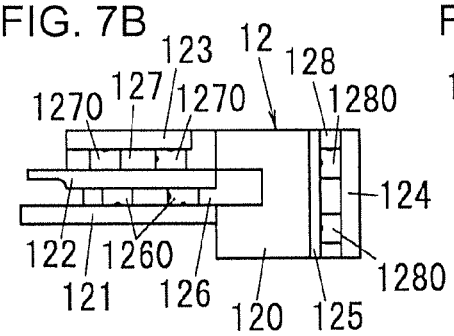
Figure 7A:
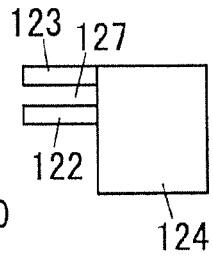
Figure 7C:
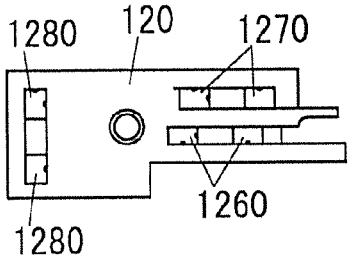
Figure 7E:
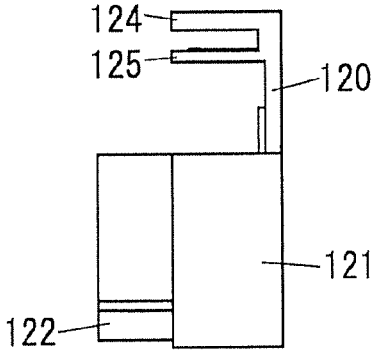
Figure 7F:
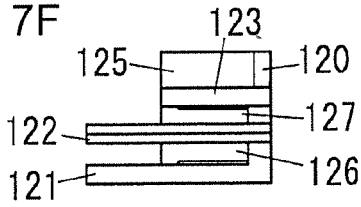

The contact spring 7 includes multiple (three in the present embodiment) plate springs 70 and an interconnection member 71 (see FIG. 4). The plate spring 70 includes a main piece 700 in a band shape, an inclined piece 701 extending obliquely from a front end (lower end) of the main piece 700, and an attachment piece 702 in a rectangular shape protruding from a front end (lower end) of the inclined piece 701 in parallel with the main piece 700. As shown in FIG. 6, these three plate springs 70 are coupled with each other so that the main pieces 700 are in a stack and the attachment pieces 702 are in a stack.

The interconnection member 71 includes an attachment part 710 in a rectangular shape, an inclined part 711 protruding obliquely downward from a center of a lower end of the attachment part 710, and a connection piece 712 extending from a front end (lower end) of the inclined part 711 in parallel with the attachment part 710 (see FIG. 4).

The attachment part 710 is situated on the attachment pieces 702 of the plate springs 70. The movable contact 4 is provided to a surface (right side) of the attachment part 710 so as to penetrate through the three attachment pieces 702 and the attachment part 710. Further, in the connection piece 712, a front end (lower end) part is wider than a remaining part. The connection piece 712 is coupled to the card 13 at the wide front end part.

Further, the contact spring 7 is connected to the second terminal 6 at a further end part (upper end of the main piece 700) of the plate spring 70 (see FIG. 4). The second terminal 6 includes a terminal piece 60, a fixing piece 61, an inclined piece 62, and an interconnection piece 63, which are formed integrally by use of metal. The terminal piece 60 is in a rectangular flat plate shape, and includes a screw hole 600 penetrating through its center. A terminal screw is screwed into the screw hole 600.

The fixing piece 61 is in a rectangular flat plate shape, and the further end (upper end) of the plate spring 70 of the contact spring 7 is fixed (swaged) to the fixing piece 61. The inclined piece 62 is in a rectangular flat plate shape, and extends obliquely downward (in a left lower direction) from the lower end of the fixing piece 61. The interconnection piece 63 is in a rectangular flat plate shape, and interconnects the upper end of the terminal piece 60 and the lower end of the inclined piece 62.

The fixed contact 3 which is to be in contact with the movable contact 4 is provided to the first terminal 5. The first terminal 5 includes a terminal piece 50, an attachment piece 51, a supporting piece 52, and an interconnection piece 53, which are formed integrally by use of metal. The terminal piece 50 is in a rectangular flat plate shape, and includes a screw hole 500 penetrating through its center. A terminal screw is screwed into the screw hole 500.

The attachment piece 51 is in a rectangular flat plate shape, and the fixed contact 3 is attached to a center of the attachment piece 51. The supporting piece 52 includes: a main piece 520 having the front end connected to the terminal piece 50; and an inclined piece 521 extending obliquely upward from the upper edge of the main piece 520. The interconnection piece 53 is in a rectangular flat plate shape, and interconnects the upper end of the inclined piece 521 and the right end of the attachment piece 51.

In the present embodiment, the fixed contact 3 and the first terminal 5 constitute a fixed contact member, and the movable contact 4, the second terminal 6 and the contact spring 7 constitute a movable contact member.

The card 13 of the driving block is made of resilient material (e.g., a metal plate), and is fixed to each of the armature 8 and the contact spring 7.

Figure 5:
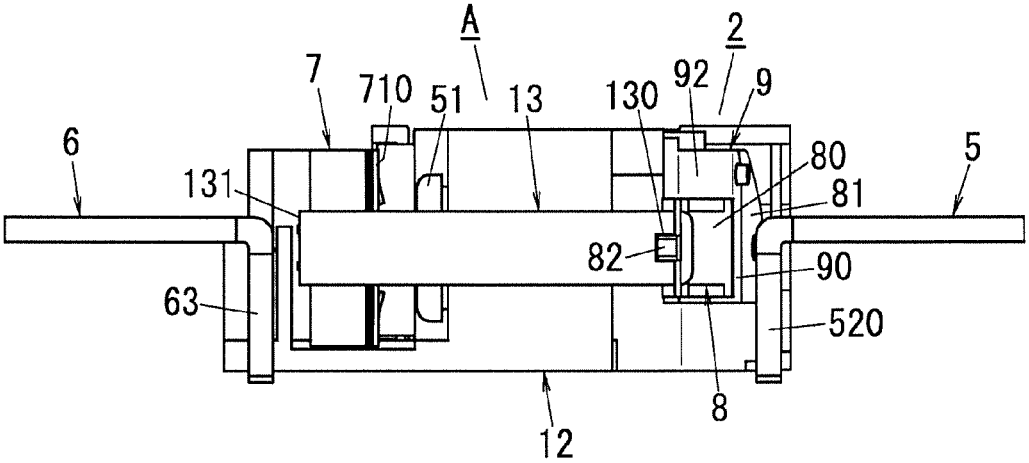
FIG. 5 is a right side view illustrating the relay body of the contact device of the embodiment in accordance with the present invention.

The card 13 is in a band shape as shown in FIG. 5 and FIG. 6, and includes one end in a length direction through which a rectangular hole 130 penetrates, and another end in the length direction bent at the right angle. The card 13 is fixed to the armature 8 by swaging the projection 82 inserted into the hole 130. Further, in the card 13, the part which is bent at the right angle (hereinafter referred to as a second fixing part 131) is fixed (swaged) to the contact spring 7 (the connection piece 712 of the interconnection member 71).

As shown in FIG. 7, the positioning member 12 is a synthetic resin molded product including a bottom wall 120, a first longitudinal wall 121, a second longitudinal wall 122, a third longitudinal wall 123, a fourth longitudinal wall 124, and a fifth longitudinal wall 125 which are formed integrally.

The bottom wall 120 is in a flat hook shape. The first longitudinal wall 121 to the fifth longitudinal wall 125 are in an almost rectangular flat plate shape, and extend in the same direction from a surface of the bottom wall 120. The first longitudinal wall 121, the second longitudinal wall 122, and the third longitudinal wall 123 are arranged in parallel with each other at intervals on a narrow part of the bottom wall 120.

Note that, a space between the first longitudinal wall 121 and the second longitudinal wall 122 is defined as a first groove 126, and a space between the second longitudinal wall 122 and the third longitudinal wall 123 is defined as a second groove 127. The fourth longitudinal wall 124 and the fifth longitudinal wall 125 are arranged in parallel with each other at an interval on an end of a broad part of the bottom wall 120. Note that, a space between the fourth longitudinal wall 124 and the fifth longitudinal wall 125 is defined as a third groove 128.

Further, with regard to the bottom wall 120, a pair of holding holes (first holding holes) 1260 are arranged in a length direction of the first groove 126 in a bottom of the first groove 126. Further, with regard to the bottom wall 120, a pair of holding holes (second holding holes) 1270 are arranged in a length direction of the second groove 127 in a bottom of the second groove 127. Furthermore, with regard to the bottom wall 120, a pair of holding holes (third holding holes) 1280 are arranged in a length direction of the third groove 128 in a bottom of the third groove 128.

Each of the pair of first holding holes 1260, the pair of second holding holes 1270, and the pair of third holding holes 1280 is a rectangular through hole penetrating through the bottom wall 120. Note that, protrusions are provided to an inner circumferential surface of each of the first holding holes 1260, the second holding holes 1270, and the third holding holes 1280.

The main piece 221 of the heel piece 22 constituting the driver 2 is inserted into the first groove 126. This main piece 221 includes a pair of protrusions. The pair of protrusions are pressed into the first holding holes 1260, and thereby the main piece 221 of the heel piece 22 is held and positioned in the first groove 126 (see FIG. 4).

Further, the interconnection piece 53 of the first terminal 5 is inserted into the second groove 127. The interconnection piece 53 also includes a pair of protrusions 530 (see FIG. 6). The pair of protrusions 530 are pressed into the second holding holes 1270, and thereby the interconnection piece 53 of the first terminal 5 is held and positioned in the second groove 127 (see FIG. 4).

Further, the interconnection piece 63 of the second terminal 6 is inserted into the third groove 128. The interconnection piece 63 also includes a pair of protrusions. The pair of protrusions are pressed into the third holding holes 1280, and thereby the interconnection piece 63 of the second terminal 6 is held and positioned in the third groove 128 (see FIG. 4).

In summary, the positioning member 12 is configured to define a positional relationship between the armature 8, the driver 2, the fixed contact 3, the movable contact 4, the contact spring 7, and the card 13. Further, the driver 2, the first terminal 5, and the second terminal 6 are held by the positioning member 12 to constitute the relay body A.

There are rectangular holes 101A and 101B penetrating through left and right corners of a lower part of a bottom plate 100 of the body 10 respectively. Further, there are multiple protrusions provided to an inner circumferential surface of the left hole 101A. A rear end part of the interconnection piece 63 of the second terminal 6 is inserted into the left hole 101A. Further, a rear end part of the main piece 520 of the first terminal 5 is inserted into the right hole 101B. In short, the relay body A is accommodated in the body 10 while the rear end of the interconnection piece 63 of the second terminal 6 is supported on the body 10 (see FIG. 1).

Further, when the relay body A is accommodated in the body 10, the coil terminals 212 of the driver 2 protrude to an outside of the body 10 through a groove 102 provided to an upper side plate of the body 10 (see FIG. 1). Note that, there is a cuboidal rib 103 which has a length direction parallel to the forward and rearward direction and protrudes outward (upward) from a surface (upper face) of the side plate.

In the body 10, there is an arc extinguishing member placed inside a space surrounded by the driver 2, the armature 8, contacts (the fixed contact 3 and the movable contact 4), and the card 13. The arc extinguishing member is constituted by a permanent magnet 14 and a yoke 15 (heel piece). The permanent magnet 14 is in a rectangular flat plate shape, and is magnetized to have different poles in a thickness direction. In the forward and rearward direction, the yoke 15 is in an L-shape. The permanent magnet 14 and the yoke 15 are accommodated in an accommodation part 104 provided to the body 10.

The accommodation part 104 is in a box shape whose outer shape is an L-shape in the forward and rearward direction, and protrudes forward from the bottom plate 100 of the body 10 (see FIG. 2). Further, the accommodation part 104 is hollow, and therefore the permanent magnet 14 and the yoke 15 are inserted into the accommodation part 104 through an insertion opening 1040 formed in a rear side of the body 10 and are accommodated (see FIG. 3).

Next, a process of assembling the contact device of the present embodiment is briefly described.

First, the second fixing part 131 of the card 13 is engaged with the connection piece 712 of the contact spring 7, and thereafter the driver 2, the first terminal 5, and the second terminal 6 are held by the positioning member 12. Thereafter, the first fixing part (hole 130) of the card 13 is engaged with the projection 82 of the armature 8, and thereby the relay body A is assembled.

Subsequently, the relay body A is accommodated in the body 10. At this time, the rear end part of the interconnection piece 63 of the second terminal 6 is pressed into the hole 101A of the bottom plate 100 of the body 10, and thereby the relay body A is positioned and fixed to the body 10. Further, by covering the cover 11 with the body 10 from front, the case 1 is assembled. At last, the permanent magnet 14 and the yoke 15 are accommodated in the accommodation part 104 of the body 10, and thereby assembling of the contact device of the present embodiment is completed.

Note that, there are cut-outs 111 formed in left and right side walls of the cover 11 to allow the terminal piece 50 of the first terminal 5 and the terminal piece 60 of the second terminal 6 to protrude outside (see FIG. 2 and FIG. 3).

Further, there is a groove 112 in an upper side wall of the cover 11, and this groove 112 receives the rib 103 of the body 10 (see FIG. 3).

Next, operation of the contact device of the present embodiment is described with reference to FIG. 1. While no voltage is applied between the coil terminals 212, the driver 2 does not operate the armature 8. Therefore, the contact spring 7 is not pulled by the card 13, and the movable contact 4 and the fixed contact 3 face each other to form a predetermined gap therebetween. At this time, the first terminal 5 and the second terminal 6 are in a non-conduction state (off-state).

In contrast, while a voltage is applied between the coil terminals 212, the driver 2 operates the armature 8, and the armature 8 rotates counterclockwise. Therefore, the contact spring 7 is pulled by the card 13 and is bent in a right direction. Therefore, the movable contact 4 is in contact with the fixed contact 3. At this time, the first terminal 5 and the second terminal 6 are in a conduction state (on-state).

Note that, when a voltage is not applied between the coil terminals 212 in the on-state, the armature 8 rotates clockwise, and the contact device returns to the off-state.

When the contact returns from the on-state to the off-state, arc discharge may occur between the movable contact 4 and the fixed contact 3. When arc discharge occurs, it is necessary to extinguish the resultant arc in order to end arc discharge in short time.

In view of this, the contact device of the present embodiment accommodates, in the accommodation part 104 of the body 10, the arc extinguishing member constituted by the permanent magnet 14 and the yoke 15. In more details, the permanent magnet 14 and the yoke 15 form a magnetic field around the fixed contact 3 and the movable contact 4, and thereby an arc is elongated by electromagnetic force caused by the magnetic field, and this results in extinguishment of the arc.

Figure 8:
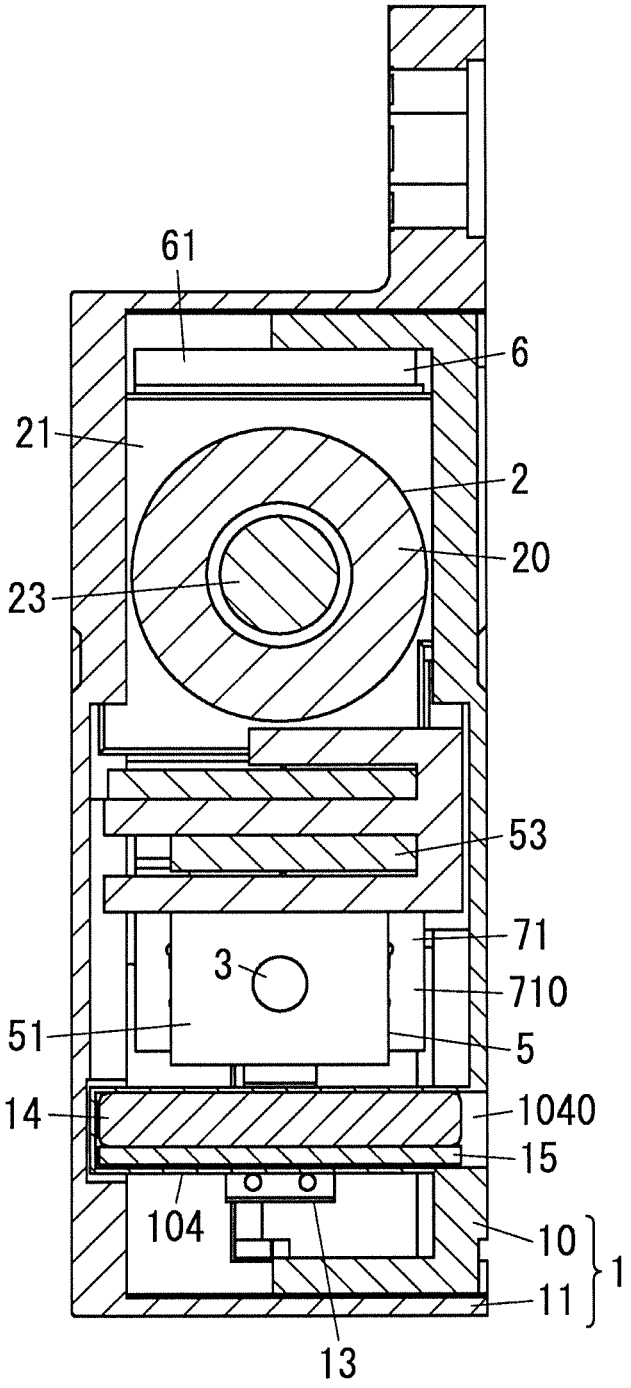
FIG. 8 is a section illustrating the contact device of the embodiment in accordance with the present invention.

FIG. 8 is a section illustrating the contact device of the present embodiment. The accommodation part 104 for accommodating the permanent magnet 14 and the yoke 15 is partitioned from an internal space of the case 1, and is connected to the insertion opening 1040 formed in an outer surface of the body 10 of the case 1.

Therefore, even after the case 1 is assembled, the permanent magnet 14 and the yoke 15 can be accommodated in the accommodation part 104. Therefore, even when foreign substances occurring in a production process (e.g., abrasion powder from metal) adhere to the permanent magnet 14, such foreign substances are prevented from intruding into the case 1. Hence, it is possible to propose a contact device capable of suppressing a decrease in the breaking performance.

Note that, in the present embodiment, the first accommodation part for accommodating the permanent magnet 14 and the second accommodation part for accommodating the yoke 15 are formed integrally with each other (the accommodation part 104). Alternatively, the first accommodation part and the second accommodation part may be formed separately from each other. Note that, the present embodiment relates to an example in which the attachment part 710 of the interconnection member 71 and the movable contact 4 are provided as separate parts, and also the attachment piece 51 and the fixed contact 3 are provided as separate parts. However, the attachment part 710 of the interconnection member 71 and the movable contact 4 may be provided as a single part, and/or the attachment piece 51 and the fixed contact 3 may be provided as a single part.

As described above, the contact device of the first aspect in accordance with the present invention includes a fixed contact member (the fixed contact 3 and the first terminal 5), a movable contact member (the movable contact 4, the second terminal 6, and the contact spring 7), a permanent magnet 14, and a case 1. The fixed contact member includes a fixed contact 3. The movable contact member includes a movable contact 4 and is movable between a position where the movable contact 4 is in contact with the fixed contact 3 and a position where the movable contact 4 is away from the fixed contact 3. The permanent magnet 14 forms a magnetic field around the fixed contact 3. The case 1 is for accommodating at least the fixed contact member and the movable contact member. The case 1 includes an accommodation part (accommodation part 104) which is partitioned from an internal space of the case 1 and is for accommodating the permanent magnet 14 through an opening thereof directed to an outside of the case 1.

In the contact device of the second aspect in accordance with the present invention, realized in combination with the first aspect, the contact device further includes a heel piece (yoke 15) forming a magnetic circuit together with the permanent magnet 14. The case 1 includes a first accommodation part which serves as the accommodation part, and a second accommodation part which is partitioned from the internal space of the case 1 and is for accommodating the yoke through an opening thereof directed to the outside of the case 1.

In the contact device of the third aspect in accordance with the present invention, realized in combination with the second aspect, the first accommodation part and the second accommodation part are formed integrally with each other.

In the contact device of the fourth aspect in accordance with the present invention, realized in combination with the first aspect, the contact device further includes an armature 8, a driver 2, a contact spring 7, and a card 13. The driver 2 is for driving the armature 8. The contact spring 7 is for holding the movable contact 4 so as to allow the movable contact 4 to be in contact with and separate from the fixed contact 3. The card 13 interconnects the armature 8 and the contact spring 7. The card 13 is made of resilient material and is fixed to each of the armature 8 and the contact spring 7.

In the contact device of the fifth aspect in accordance with the present invention, realized in combination with the fourth aspect, the card 13 is more flexible in a direction perpendicular to a contact and separation direction of the movable contact 4 than in the contact and separation direction.

In the contact device of the sixth aspect in accordance with the present invention, realized in combination with the fourth or fifth aspect, the card 13 is made of metal.

The invention claimed is:

1. A contact device, comprising:

a fixed contact member including a fixed contact;

a movable contact member which includes a movable contact and is movable between a position where the movable contact is in contact with the fixed contact and a position where the movable contact is away from the fixed contact;

a permanent magnet forming a magnetic field around the fixed contact;

a case for accommodating at least the fixed contact member and the movable contact member;

an armature;

a driver for driving the armature;

a contact spring for holding the movable contact so as to allow the movable contact to be in contact with and separate from the fixed contact;

a card interconnecting the armature and the contact spring; and a heel piece forming a magnetic circuit together with the permanent magnet, the case including a first accommodation part which is partitioned from an internal space of the case and is for accommodating the permanent magnet through an opening thereof directed to an outside of the case, and a second accommodation part which is partitioned from the internal space of the case and is for accommodating the heel piece through an opening thereof directed to the outside of the case, and the card being resilient and fixed to each of the armature and the contact spring.

2. The contact device according to claim 1, wherein the card is more flexible in a direction perpendicular to a contact and separation direction of the movable contact than in the contact and separation direction.

3. The contact device according to claim 1, wherein the card is made of metal.

4. The contact device according to claim 1, wherein the first accommodation part and the second accommodation part are formed integrally with each other.

5. A contact device, comprising:

a fixed contact member including a fixed contact;

a movable contact member which includes a movable contact and is movable between a position where the movable contact is in contact with the fixed contact and a position where the movable contact is away from the fixed contact;

a permanent magnet forming a magnetic field around the fixed contact;

a case for accommodating at least the fixed contact member and the movable contact member;

an armature;

a driver for driving the armature;

a contact spring for holding the movable contact so as to allow the movable contact to be in contact with and separate from the fixed contact; and a card interconnecting the armature and the contact spring, the case including an accommodation part which is partitioned from an internal space of the case and is for accommodating the permanent magnet through an opening thereof directed to an outside of the case, the card being resilient and fixed to each of the armature and the contact spring, and the card is made of metal.

6. The contact device according to claim 5, wherein the card is more flexible in a direction perpendicular to a contact and separation direction of the movable contact than in the contact and separation direction.

7. The contact device according to claim 5, wherein:

the contact device further includes a heel piece forming a magnetic circuit together with the permanent magnet; and the case includes a first accommodation part which serves as the accommodation part, and a second accommodation part which is partitioned from the internal space of the case and is for accommodating the heel piece through an opening thereof directed to the outside of the case.

8. The contact device according to claim 6, wherein:

the contact device further includes a heel piece forming a magnetic circuit together with the permanent magnet; and the case includes a first accommodation part which serves as the accommodation part, and a second accommodation part which is partitioned from the internal space of the case and is for accommodating the heel piece through an opening thereof directed to the outside of the case.

9. The contact device according to claim 7, wherein the first accommodation part and the second accommodation part are formed integrally with each other.

10. The contact device according to claim 8, wherein the first accommodation part and the second accommodation part are formed integrally with each other.

* * * * *